US005795021A

United States Patent [19]

Rogers

[11] Patent Number: 5,795,021

[45] Date of Patent: Aug. 18, 1998

[54] GLIDING RECLINING CHAIR

[76] Inventor: W. Clark Rogers, P.O. Box 1740, Denton, N.C. 27239

[21] Appl. No.: 957,409

[22] Filed: Oct. 23, 1997

Related U.S. Application Data

[63] Continuation of Ser. No. 541,672, Oct. 10, 1995, abandoned.

[51] Int. Cl.[6] ..... A47C 3/02; A47C 1/038

[52] U.S. Cl. ..... 297/281; 297/89; 297/75; 297/DIG. 7; 297/259.2

[58] Field of Search ..... 297/89, 88, DIG. 7, 297/259.2, 259.3, 281, 273, 329, 75, 68

[56] References Cited

U.S. PATENT DOCUMENTS

| | | | |
|---|---|---|---|
| 144,603 | 11/1873 | Enger | 297/329 |
| 195,395 | 9/1877 | Pope | 297/75 |
| 2,142,714 | 1/1939 | Campbell | 297/329 X |
| 2,869,619 | 1/1959 | Petersen et al. | 297/75 X |
| 3,054,639 | 9/1962 | Schliephacke | 297/89 |
| 3,096,118 | 7/1963 | Dubeck | 297/75 |
| 3,243,225 | 3/1966 | Katz | 297/75 |
| 4,291,913 | 9/1981 | Kowalski | 297/89 |
| 4,437,701 | 3/1984 | Mizelle | 297/88 X |
| 4,536,029 | 8/1985 | Rogers, Jr. | 297/281 |
| 4,544,201 | 10/1985 | Rogers, Jr. | 297/259.2 |
| 4,591,205 | 5/1986 | James | 297/281 X |
| 4,601,513 | 7/1986 | Pine | 297/269.1 |
| 4,700,920 | 10/1987 | Horn | 297/281 |
| 5,129,701 | 7/1992 | Pine | 297/89 X |
| 5,344,214 | 9/1994 | Trent | 297/270.3 X |
| 5,427,433 | 6/1995 | Holobaugh, Jr. | 297/281 X |

FOREIGN PATENT DOCUMENTS

| | | | |
|---|---|---|---|
| 818343 | 6/1937 | France | 297/329 |
| 3524056 | 1/1987 | Germany | 297/68 |

*Primary Examiner*—Peter M. Cuomo
*Assistant Examiner*—David E. Allred
*Attorney, Agent, or Firm*—Myers Bigel Silbey & Sajovec, LLP

[57] ABSTRACT

A glider-recliner chair that can glide both the upright and reclined positions includes a seat, a base, a footrest, and side panels. The side panels are interconnected with the base via front and rear glide links. The side panels, seat, and footrest are interconnected with a reclining mechanism. The reclining mechanism is configured so that the footrest cushions comprising the footrest are in a stacked vertical relationship when the chair is in the upright position and are positioned so that the upper footrest cushion is positioned between the lower footrest cushion and the seat when the chair is in the reclined position. The mechanism includes front and rear swing links for controlling the movement of the seat relative to the side panels and base and a footrest drive link for driving the footrest to its extended position.

18 Claims, 5 Drawing Sheets

GLIDING RECLINING CHAIR

This application is a continuation, of application Ser. No. 08/541,672, filed Oct. 10, 1995, abandoned.

FIELD OF THE INVENTION

The present invention relates generally to seating units, and relates more specifically to reclining seating units.

BACKGROUND OF THE INVENTION

For years, rocking chairs have been popular furniture pieces in the home. The repetitive rocking motion of the chair can be quite relaxing and comforting to a seated occupant. In addition, the appearance of the rocking chair is such that it can be used with a variety of furniture styles, particularly traditional styles that with a heavy emphasis on visible wood.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure is a set of swing links that are pivotally attached at their upper ends to the base and extend downwardly therefrom to attach to a structure, such as a mounting bracket, that is attached to the seat. In this configuration, the seat is suspended from the base and is free to swing forwardly and rearwardly in response to a forwardly or rearwardly-directed force applied by a seated occupant. The gliding path of the chair is controlled by the configuration and mounting of the swing links. These chairs can be constructed to resemble traditional rocking chairs and thus are quite popular.

Another type of seating unit that has become popular is the recliner chair. Recliners typically include some type of mechanism that, when actuated, causes the seat and backrest of the recliner to pivot relative to the base in order to place an occupant of the seating unit in a reclined position.

Reclining capability has been combined with gliding capability in a single unit to provide a chair that both reclines and glides. This chair includes a mechanism that enables it to move between upright and reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr.

Despite the advances described above, the glider-recliners designed heretofore have significant shortcomings. One of the more significant shortcomings is the size of the reclining mechanism. The reclining mechanism must fit within the volume bounded by peripheries of the seat and the base, and must be positioned above the underlying surface a sufficient distance that the chair has adequate space to glide. This has been accomplished in large, bulky chairs such as those illustrated in the Rogers patents, but the prior art mechanisms have been too large to use with a traditionally-sized rocking chair or glider, which typically have only about 8 to 10 inches of height and 16 to 18 inches of length available for a mechanism.

This problem of available space is exacerbated by government safety standards that require that recliners with extendable footrests to have a gap of no more than 5 inches between frame members of extended footrest cushions and the seat when the chair is in the reclined position. To conform with this regulation (promulgated by the Consumer Product Safety Commission), designers have included a supplemental footrest cushion that is positioned between a larger main footrest cushion and the seat in the extended position. In the upright position, the supplemental footrest cushion is positioned behind the main footrest cushion and is out of view. The presence of the supplemental footrest cushion further reduces space below the seat and thereby limits further the number of seating units that have sufficient under-the-seat volume to house both reclining mechanisms and gliding mechanisms.

In view of the foregoing, it is an object of the present invention to provide a reclining chair with gliding capability that has the size and style of a traditional rocking chair.

It is also an object of the present invention to provide a reclining mechanism for such a chair.

SUMMARY OF THE INVENTION

These and other objects are satisfied by the present invention, which as a first aspect includes a reclining seating unit that comprises: a base configured to rest on an underlying surface; a generally horizontally-disposed seat positioned above the base; a pair of footrest panels; and a reclining mechanism interconnecting the seat, the base, and the footrest panels for relative movement therebetween. The reclining mechanism is configured so that the seating unit is movable between an upright position and a reclined position. In the upright position, the pair of footrest panels are disposed generally upright and are positioned in vertically stacked relationship below a forward portion of the seat. In the reclined position, the footrest panels are generally horizontally disposed and are positioned forwardly of the seat. A seating unit of this configuration can have an attractive appearance, particularly in a rocking chair design, and can satisfy the maximum gap requirement for extendable footrests set forth above, while retaining a relatively small size as is traditional for a rocking chair.

A second aspect of the present invention is a reclining mechanism suitable for use with such a seating unit. In particular, the mechanism includes a footrest linkage that is configured so that, in the reclined position, one of the footrest panels is disposed between the other of the footrest panels and the seat.

As a third aspect, the present invention provides a reclining seating unit which comprises: a base configured to rest on an underlying surface; a generally horizontally-disposed seat positioned above the base which includes a pair of rails attached to a lateral portion thereof, each of which has an arcuate lower edge; a pair of side panels positioned generally below the seat, each of which includes an arcuate upper edge positioned generally below a respective seat rail lower edge; at least one footrest panel; and a reclining mechanism interconnecting the seat, the side panels, and the footrest panel for relative movement therebetween. The reclining mechanism is configured so that the seating unit is movable between an upright position and a reclined position. In the upright position, the seat is disposed at a first pitch angle relative to the underlying surface and is positioned in a first forward orientation relative to the side panels, and the footrest panel is generally upright and is positioned below a forward portion of the seat. In the reclined position, the seat is disposed at a second pitch angle relative to the underlying surface that differs from the first pitch angle and is positioned in a second rearward orientation relative to the side panels, and the footrest panel is generally horizontally disposed and is positioned forwardly of the seat. The side panel upper edges and the seat rail lower edges are shaped so that, as the seating unit moves between the upright and reclined positions, the seat rail lower edges move generally longitudinally relative to and remain in adjacent relationship with the side panel upper edges. As for the embodiment described above, this seating unit can have an attractive appearance in either of the upright and reclined positions, as the side panels and seat rails move relative to one another so as to maintain a relatively consistent gap therebetween. Also, the ability of the side panels and seat rails to maintain a relatively consistent narrow gap improves the safety of the seating unit.

Preferably, such a seating unit includes gliding means interconnecting each of the side panels with the base. The gliding means is configured so that the side panels, the seat, the backrest, and the footrest panel are free to travel along a predetermined generally longitudinal path relative to the base.

A fourth aspect of the present invention is a mechanism that is particularly suitable for use with glider rockers. Such a mechanism comprises: a seat bracket adapted for fixed attachment to the seat of a seating unit; a mounting bracket adapted for fixed attachment to the base of the seating unit; reclining means for pivotally interconnecting the seat bracket and the mounting bracket to control movement of the seat relative to the base between first upright and second reclined positions; a footrest linkage pivotally interconnected with the seat bracket and adapted for fixed attachment to the footrest, wherein the footrest linkage is configured to move the footrest between a retracted position when the glider rocker is in its upright position and an extended position when the glider rocker is in its reclined position; footrest actuation means for actuating the extension of the footrest linkage when the seating unit moves to its reclined position, wherein the footrest extension means is pivotally interconnected with the footrest linkage and with the mounting bracket; and an actuation linkage comprising an axle extending through an aperture in the mounting bracket for rotation therein, a bell crank fixed at one end to the axle, a drive link pivotally interconnected at one end with the bell crank at the end thereof opposite the axle and further pivotally interconnected with the seat link, and a handle fixed to the axle for effecting rotation thereof. The drive linkage, the reclining means, and the footrest extension means are configured and arranged so that rotation of the drive linkage axle within the mounting bracket aperture causes the bell crank to drive the drive link generally rearwardly. The rearward movement of the drive link draws the seat bracket rearwardly relative to the mounting bracket into the reclined position, and the rearward movement of the seat bracket causes the footrest actuation means to extend the footrest linkage. This mechanism is particularly well-suited for glider rockers and other seating units having limited space beneath the seat, as the actuating mechanism folds into a very compact configuration in its upright position.

A fifth aspect of the present invention is a mechanism for use in a seating unit having a base, a seat positioned generally above the base, and an extendable footrest comprising a footrest panel. The mechanism controls the movement of the seating unit between an upright position and a reclined position, wherein in the upright position, the seat is in a first position relative to the base and the footrest panel is generally vertically disposed below a forward portion of the seat, and in the reclined position, the seat is in a second position relative to the base, the second position being rearward of the first position, and the footrest panel is generally horizontally disposed and positioned forwardly of the seat. The mechanism comprises: a seat bracket adapted for fixed attachment to the seat; a mounting bracket adapted for attachment with the base; reclining means for pivotally interconnecting the seat bracket and the mounting bracket to control movement of the seat relative to the base between the first and second positions; a footrest linkage pivotally interconnected with the seat bracket and adapted for fixed attachment to the footrest, and a footrest drive link for actuating the extension of the footrest linkage when the seating unit moves to its reclined position. The reclining means comprises a front swing link pivotally interconnected with the seat bracket and with the mounting bracket and a rear swing link pivotally interconnected with the seat bracket and with the mounting bracket. The footrest linkage is configured to move the footrest between a retracted position when the seating unit is in its upright position and an extended position when the seating unit is in its reclined position. The footrest drive link is pivotally interconnected with the footrest linkage and with the mounting bracket. In this configuration, the mechanism folds into a compact package in the upright position so that it can be used with relatively small glider recliners and other seating units.

DETAILED DESCRIPTION OF THE PREFERRED EMBODIMENT

The present invention will now be described more particularly hereinafter with reference to the accompanying drawings, in which present embodiments of the invention are shown. The invention can, however, be embodied in many different forms and should not be limited to the embodiments set forth herein; rather, these embodiments are provided so that this disclosure will be thorough and complete and will fully convey the scope of the invention to those skilled in this art.

This invention is directed to a chair having a stationary base, a seat, and a backrest. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The terms "lateral", "outward" and derivatives thereof refer to the direction defined by a vector originating in the center of the seat and extending in the plane of the underlying surface perpendicular to the forward and rearward directions. The terms "inboard", "inward" and derivatives thereof refer to the direction directly opposite to the lateral direction as defined hereinabove.

In addition, mechanisms for moving portions of the seating unit illustrated herein between an upright and a reclined position are illustrated as a series of pivotally interconnected links. Those skilled in this art will appreciate that the pivots between links illustrated herein can take a variety of configurations, such as pivot pins, rivets, bolt and nut combinations, and the like, any of which would be suitable for use with the present invention.

Figure 1:
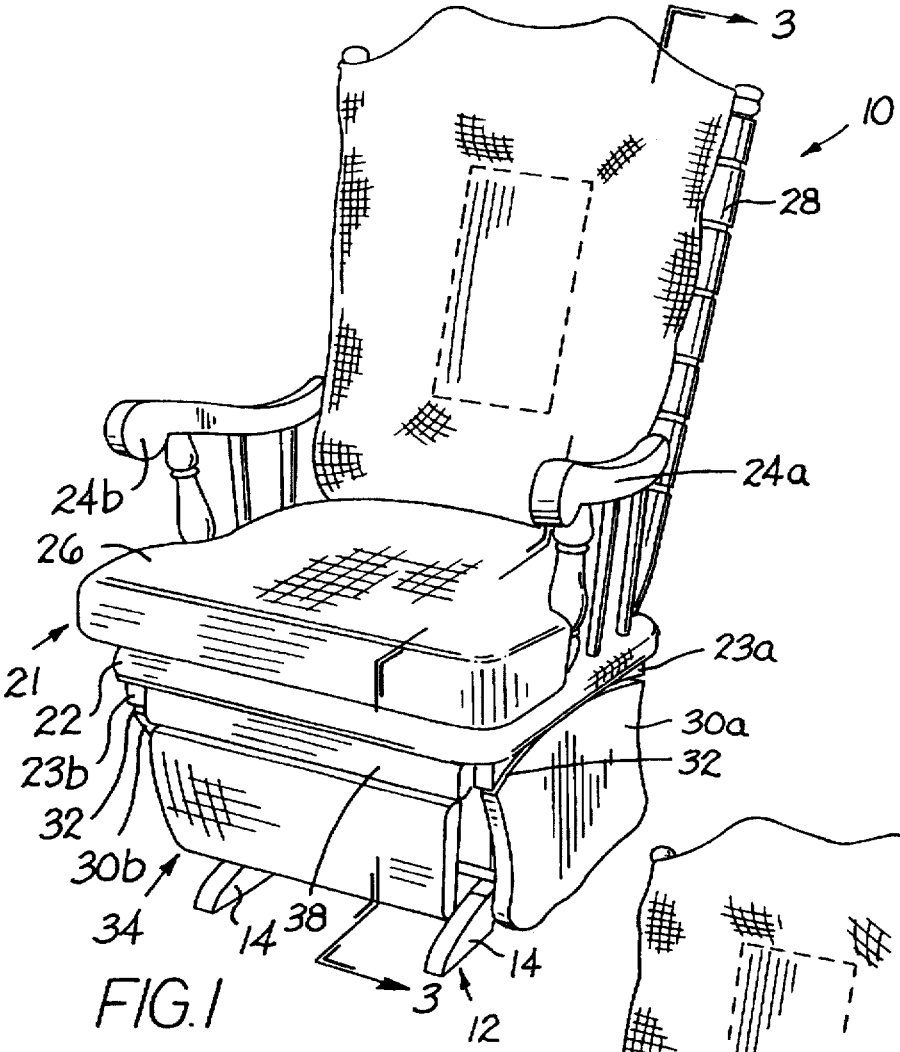
FIG. 1 is a perspective view of the glider recliner chair of the present invention, with the chair shown in its upright position.
Figure 2:
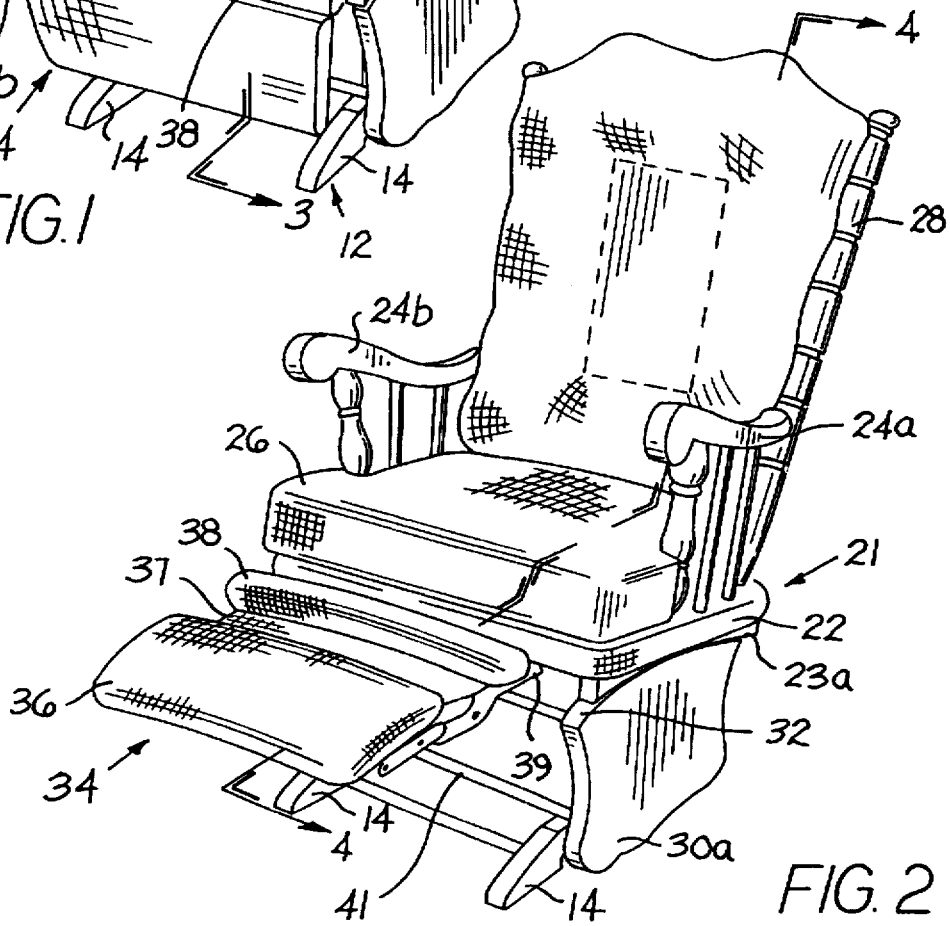
FIG. 2 is a perspective view of the chair of FIG. 1 shown with the chair in its reclined position.

Referring now to the drawings, FIGS. 1 and 2 show a gliding recliner chair, designated broadly at 10. The chair 10 includes a stationary base 12, a seat 21, a pair of armrests 24*a*, 24*b*, a backrest 28, a pair of side panels 30*a*, 30*b*, and a footrest 34. The base 12 comprises legs 14, a central tower 16 that extends upwardly from the legs 14, a pair of forward arms 18 that extend forwardly from the tower 16 (only one forward arm 18 is shown herein), and a pair of rear arms 20 that extend rearwardly from the tower 16 (only one rear arm 20 is illustrated herein). The seat 21, which is positioned generally above the base 12, includes a wooden seat panel 22 upon which rests a seat cushion 26. Each of a pair of seat rails 23*a*, 23*b* is fixed to the lower surface of the seat panel 22 and has an arcuate lower surface. The armrests 24*a*, 24*b* are fixed to and extend upwardly from lateral portions of the seat panel 22. The backrest 28 extends generally upwardly and slightly rearwardly from the rear portion of the seat panel 22 and the armrests 24*a*, 24*b*.

The side panels 30*a*, 30*b*, illustratively and preferably formed of wood, are positioned beneath the seat rails 23*a*, 23*b*. Each side panel 30*a*, 30*b* includes an arcuate upper surface 32 which matches the curvature of the arcuate lower surface of the corresponding seat rail 23*a*, 23*b*.

Each of the side panels 30*a*, 30*b* is attached to the base 12 through a pair of glide links 40, 46 (FIGS. 3 through 6). The front glide link 40 is attached to the forward end of the forward arm 18 at a pivot 42 and is also attached to the lower front portion of the side panel 30*a* at a pivot 44. A front stabilizer bar 41 is fixed to and extends transversely between central portions of the front glide links 40 beneath the base forward arms 18. Each rear glide link 46 is pivotally interconnected with a rear arm 20 at a pivot 48 and is also attached to the lower rear portion of the side panel 30*a* at a pivot 50. A rear stabilizer bar 47 extends transversely between central portions of the rear glide links 46 beneath the base rear arms 20.

The footrest 34 comprises a lower footrest cushion 36 and a somewhat shorter upper footrest cushion 38. Adjacent edges of the upper and lower footrest cushions 38, 36 are attached via a fabric connecting sheet 37. Also, adjacent edges of the upper footrest cushion 38 and the seat panel 22 are interconnected with a fabric connecting sheet 39.

The relative movement of the side panels 30*a*, 30*b* and the fixed unit comprising the seat 21, the armrest 24*a*, 24*b*, and the backrest 28 is controlled by a pair of mechanisms 60. The mechanisms 60 are mirror images of one another about a plane of symmetry that is perpendicular to the underlying surface and bisects the chair 10 between the armrests 24*a*, 24*b*. In the interest of clarity and brevity, only one mechanism 60 will be described herein; those skilled in this art will appreciate that this discussion is applicable to the mirror image mechanism 60 also.

The mechanism 60 comprises a side panel bracket 62, which is fixed to the side panel 30*a*, a seat bracket 80, which is fixed beneath the seat panel 22, rear and front swing links 90, 96, which interconnect the side panel bracket 62 and the seat bracket 80, an actuating linkage 100, and a footrest linkage 130, which interconnects the seat bracket 80, the lower footrest cushion 36, and the upper footrest cushion 38. The reclining mechanism 60 is configured so that, when the chair 10 is in the upright position, the seat panel 22 is disposed at a first pitch angle relative to the underlying surface and positioned in a first position relative to the side panels 30*a*, 30*b*, and the footrest cushions 36, 38 are generally upright and positioned below the forward portion of the seat 21, and when the chair 10 is in the reclined position, the seat 21 is disposed at a second pitch angle relative to the underlying surface that is steeper than the first pitch angle and is positioned in a second position relative to the side panels 30*a*, 30*b* that is rearward from its first position, and the footrest cushions 36, 38 are generally horizontally disposed and positioned forwardly of the seat 21.

Figure 6:
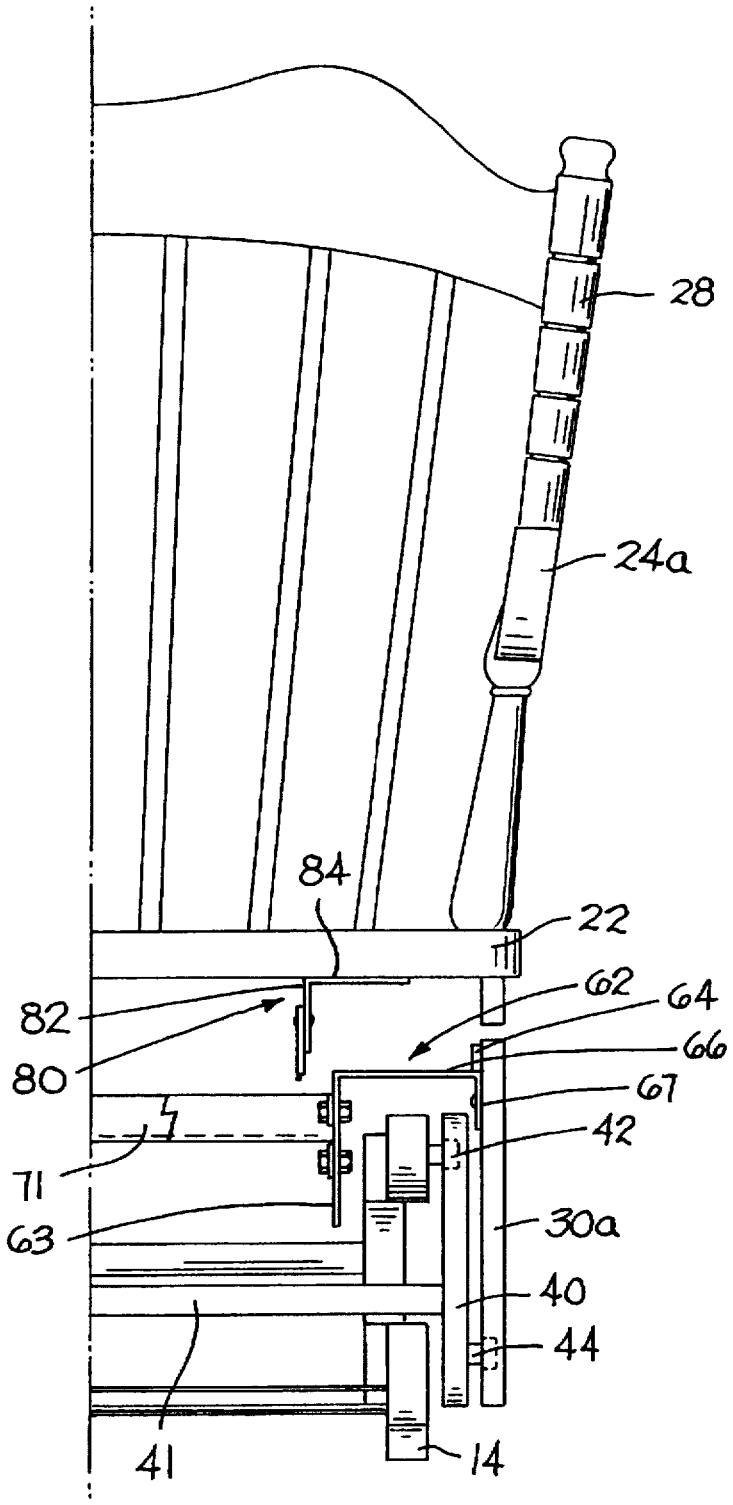
FIG. 6 is a fragmentary front view of the chair of FIG. 1.

The side panel bracket 62 comprises a generally vertically-disposed main body 63, a horizontal panel 66 that extends laterally from the upper edge of the main body 63, an upwardly-extending lateral flange 64, which merges with and extends upwardly from a lateral portion of the horizontal panel 66, and a pair of downwardly extending lateral flanges 67, which extend downwardly from front and lateral portions of the horizontal panel 66 (FIG. 6). The lateral flanges 64, 67 include apertures 65 through which bolts are inserted for attachment of the flanges 64, 67 to the inboard surface of the side panel 30*a*. The main body 63 also includes an axle aperture 69. A wedge portion 74 extends rearwardly and downwardly from the rear portion of the main body 63. A pin 75 extends inwardly from a lower central portion of the main body 63.

The side panel brackets 62 on either side of the chair 10 are fixed relative to one another by a stabilizing channel 71, which is fixed to the inboard surfaces of the side panel bracket 62 via bolts. Also, each horizontal panel 66 is stabilized relative to the main body 63 by a pair of stabilizing brackets 72 bolted beneath the horizontal panel 66 and to the lateral surface of the main body 63. The side panel bracket 62 provides a means for mounting the pivoting links of the mechanism 60 to the side panels 30*a*, 30*b*; other means for so mounting the mechanism 60, such as direct attachment of its links to the side panels 30*a*, 30*b*, can also be employed. Those skilled in this art will appreciate that the side panel bracket 62 can be attached directly to the base 12 if the seating unit 10 is a non-reclining unit.

Figure 3:
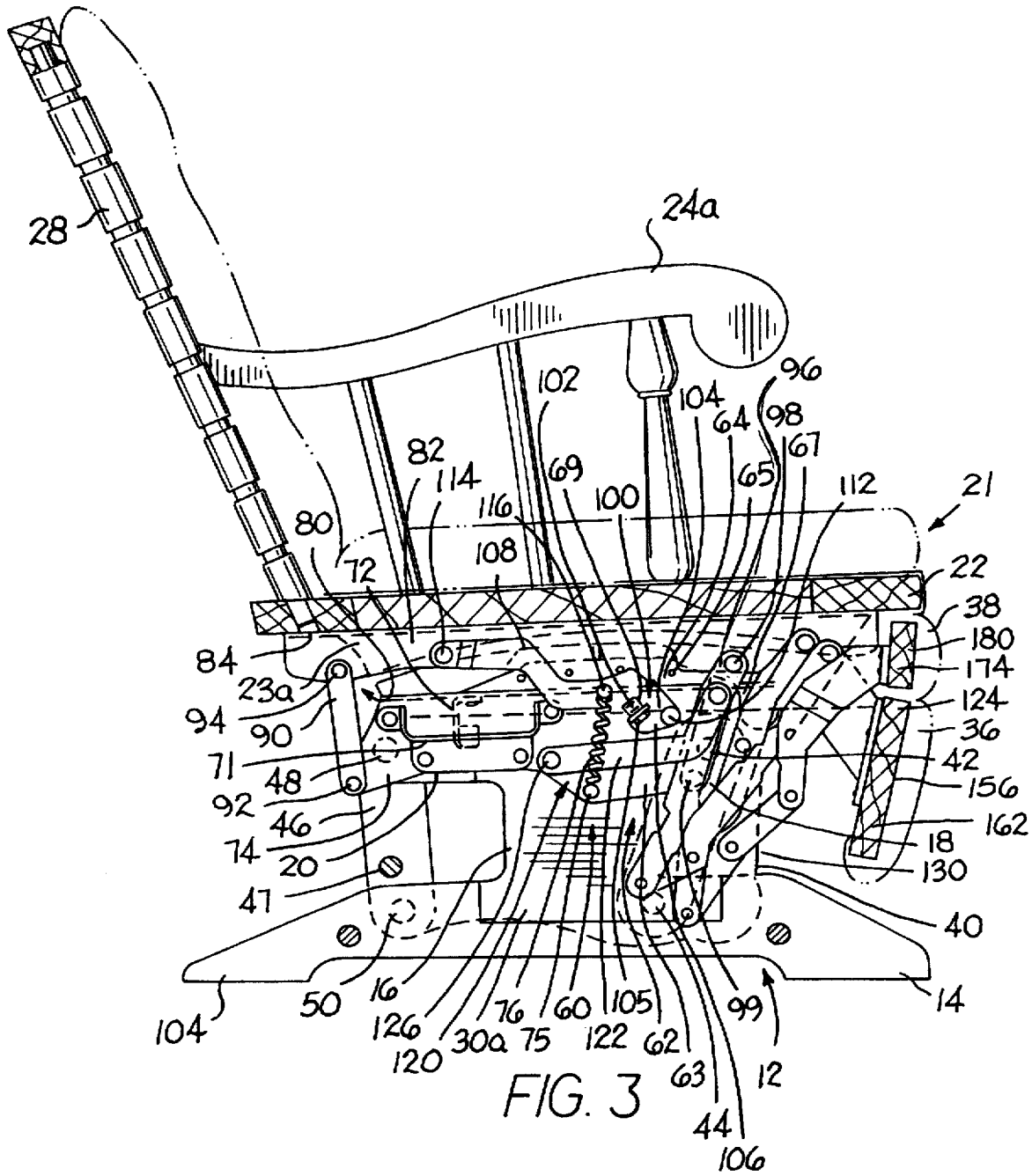
FIG. 3 is a sectional view taken along line 3:3 of FIG. 1 showing the chair and accompanying mechanism in the upright position.
Figure 4:
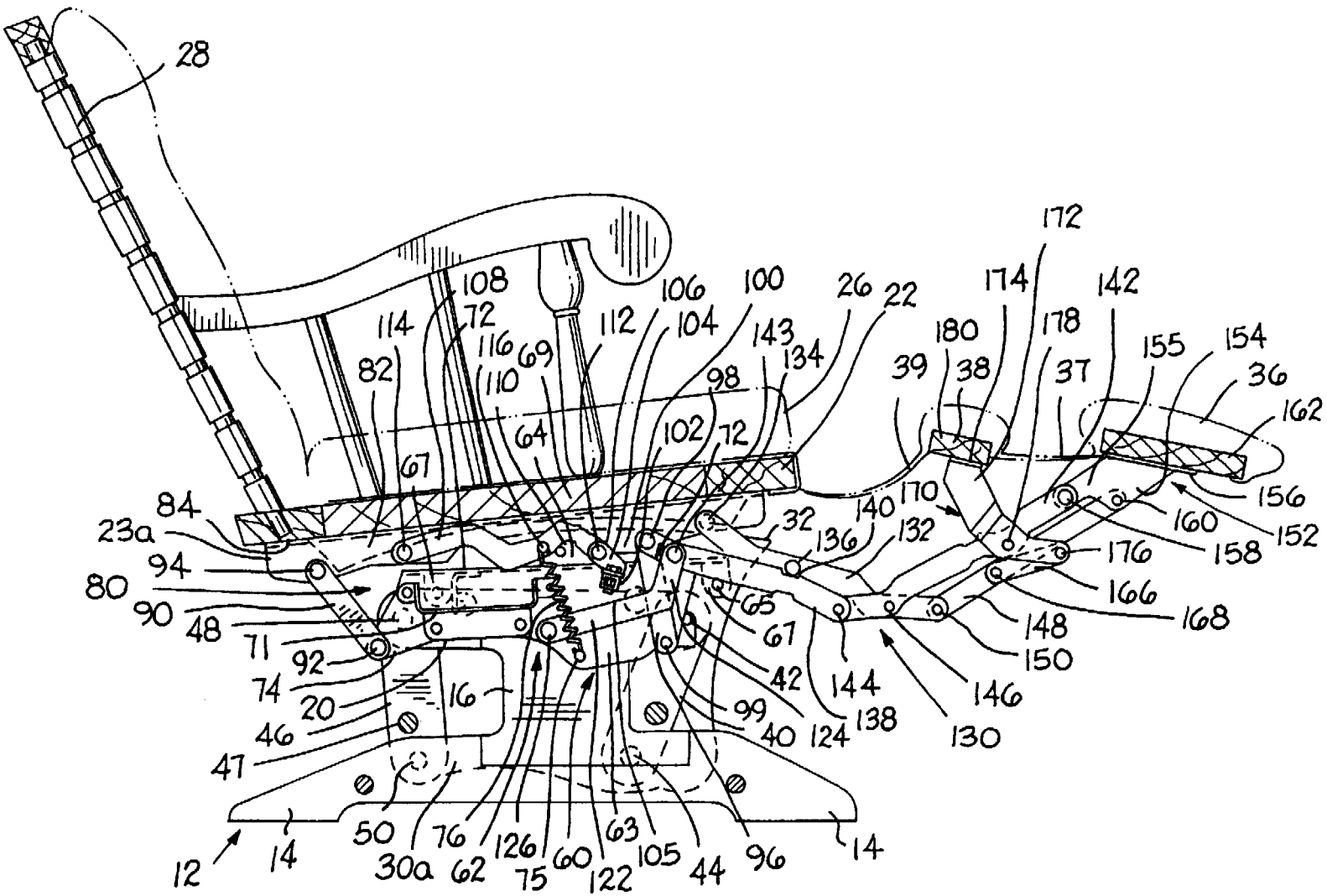
FIG. 4 is a sectional view taken along lines 4:4 of FIG. 2 showing the chair and accompanying mechanism in their reclined positions.
Figure 5:
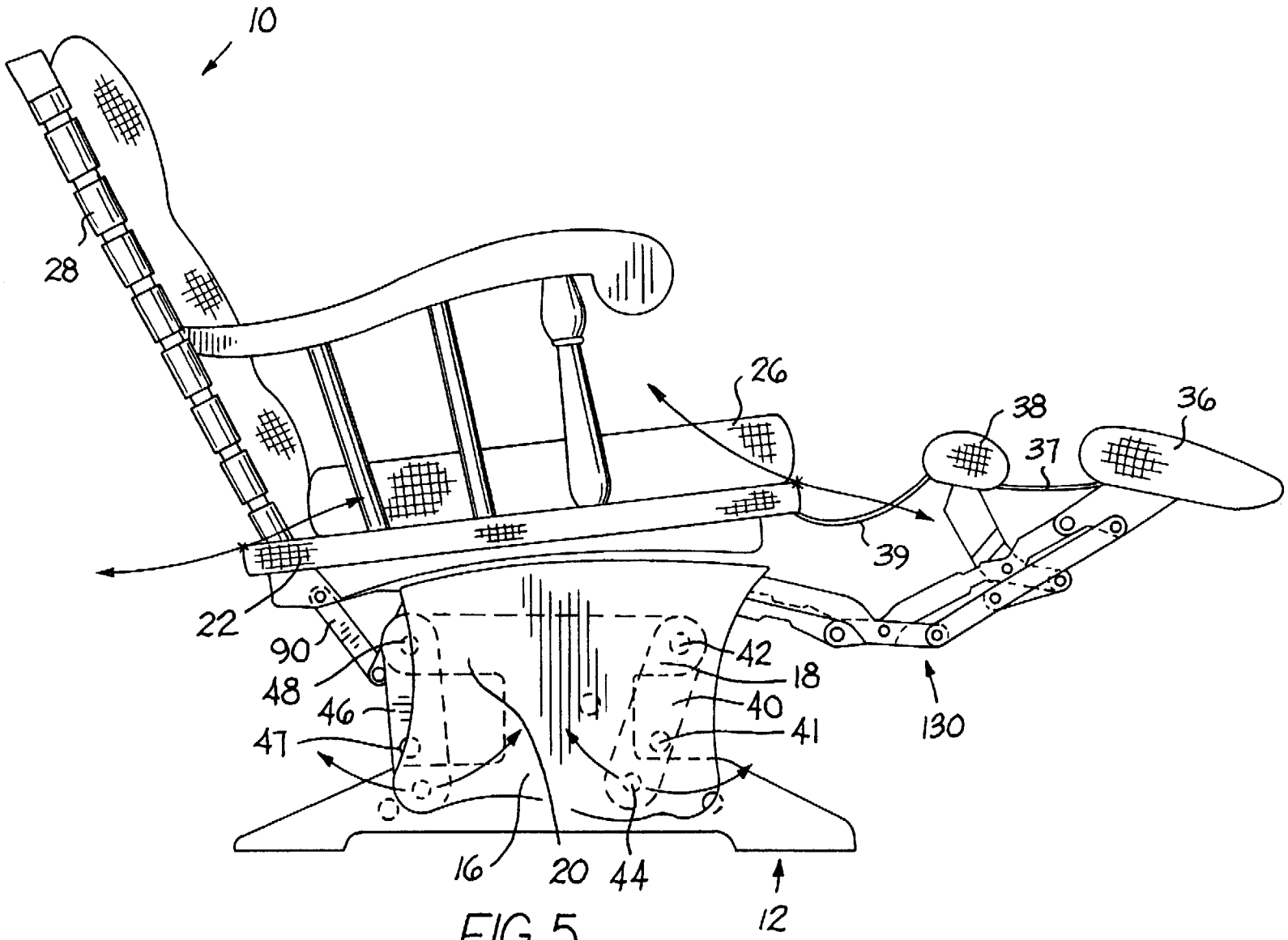
FIG. 5 is a side view of the chair of FIG. 1 in its reclined position, with the arrows indicating the approximate glide path of the chair.

The seat bracket 80 comprises a vertically-extending main body 82 and a horizontal flange 84, which extends laterally from the upper edge of the main body 82 (FIG. 6). The horizontal flange 84 includes a plurality of apertures (not shown) through which bolts are inserted for fixing the seat bracket 80 to the underside of the seat panel 22. The seat bracket 80 provides a means for attaching the seat 21 to the mechanism 60; other means for mounting the mechanism 60 to the seat 21, such as direct pivotal attachment of links of the mechanism 60 to the seat panel 22, can also be used with the present invention. Relative movement of the side panel bracket 62 and the seat bracket 80 (and thus the side panel 30*a* and the seat panel 22) is controlled by the rear and front swing links 90, 96 (FIGS. 3 through 5). The rear swing link 90 is a substantially straight link that is pivotally interconnected to the wedge portion 74 of the side panel bracket 62 at a pivot 92 and is further pivotally interconnected with the rear portion of the seat bracket main body 82 at a pivot 94. The front swing link 96 is also a substantially straight link.

It is pivotally interconnected to the forward portion of the side panel bracket main body 63 at a pivot 99 and is also pivotally interconnected with the forward portion of the seat bracket main body 82 at a pivot 98. The skilled artisan will appreciate that although the illustrated front and rear swing links 96, 90 are preferred, other configurations and mounting positions can also be used with the present invention with resulting variations in relative movement between the seat bracket 80 and the side panel bracket 62. In particular, a different swing link combination may be desirable to provide a different reclining movement; if this is done, it is preferred to adjust the shapes of the lower surfaces of the seat rails 23*a*, 23*b* and the upper surfaces 32 of the side panels 30*a*, 30*b* so that they continue to match during reclining.

Relative movement of the side panel bracket 62 and the seat bracket 80 is actuated by the actuating linkage 100. The actuating linkage 100 comprises a transversely extending axle 102, a bell crank 104, and a drive link 108. The axle 102, which illustratively and preferably is a hollow square tube, extends through the axle aperture 69 of one side panel bracket 62, across to the corresponding axle aperture 69 in the opposite seat bracket 62, and through the side panel bracket 30*a*. The end of the axle 102 that extends through the side panel bracket 30*a* is attached to an actuating handle (not shown) which the occupant can use to actuate the linkage 100. The bell crank 104 includes an inboard tab 105, which is fixed to one face of the axle 102, and an extension finger 106. The extension finger 106 is pivotally interconnected at its free end to the forward end of the drive link 108 at a pivot 112. The drive link 108 has a shallow M-shape, with the two forwardmost legs of the drive link 108 forming a forward recess 110. The rearmost end of the drive link 108 is pivotally interconnected to the main body 82 of the seat bracket 80 at a pivot 114. Also, a pin 116 extends inwardly from the drive link 108 just rearwardly of the forward recess 110 and receives the upper end of the spring 76.

The footrest linkage 130 is attached to the forward end of the seat bracket 80. Movement of the footrest linkage 130 (and consequently the lower and upper footrest cushion 36, 38) is coupled to the relative movement of the seat 21 and the side panel 30 by a footrest drive link 120. The footrest drive link 120 is an angled link that includes a rear portion 122 and a forward portion 124. The rear portion 122 is pivotally connected at its free end to a central portion of the main body 63 of the side panel bracket 62 at a pivot 126. The forward portion 124 is then connected to the footrest linkage 130. Although the configuration and pivotal interconnections of the drive link 120 as illustrated is preferred, because it enables the mechanism 60 to remain compact in the upright position, those skilled in this art will appreciate that other configurations for actuating the extension of the footrest linkage 130 may also be suitable for use with the chair 10.

The footrest linkage 130 includes upper and lower thrust links 132, 138, upper and lower extension links 142, 148, a lower footrest bracket 152, an upper footrest bracket 170, and a control link 166. The upper thrust link 132 is pivotally interconnected at one end to a forward portion of the seat bracket main body 82 at a pivot 134. A stop pin 136 extends inwardly from a central portion of the upper thrust link 132. The lower thrust link 138 is pivotally interconnected at one end to the seat bracket main body 82 at the pivot 98 that also pivotally interconnects the front swing link 96 to the seat bracket main body 82. The lower thrust link 138 includes a notch 140 on its one edge which receives the stop pin 136 when the footrest link 130 is in its extended position. At a position adjacent the pivot 98, the lower thrust link 138 is pivotally interconnected to the forward portion 124 of the footrest drive link 120 at a pivot 143. The upper extension link 142 is pivotally interconnected to the end of the lower thrust link 138 opposite the pivot 98 at a pivot 144. The upper extension link 142 is also pivotally interconnected with the upper thrust link 132 at a pivot 146, which is positioned on the end of upper thrust link 132 opposite the pivot 134. The lower extension link 148 is pivotally interconnected at one end to the upper thrust link 150 and at its opposite end to the lower footrest bracket 152. Those skilled in this art will appreciate that other pantographic linkages can also be employed to extend the footrest.

From these respective pivots with the upper and lower thrust links 132, 138, the upper and lower extension links 142, 148 extend to join these links with the lower footrest bracket 152. The lower footrest bracket 152 includes a vertical panel 154 having a rear tab 155 and a horizontal flange 156, to which is fixed a lower footrest plank 162. The lower footrest cushion 36 covers the lower footrest plank 162. The upper extension link 142 is interconnected with the rear tab 155 at a pivot 158. The lower extension link 148 is interconnected with the portion of the vertical panel 154 opposite the flange 156 at a pivot 160.

The upper footrest bracket 170 comprises a generally vertically-disposed main body 172 and a horizontal flange 174; the flange 174 is fixed to an upper footrest plank 180, which is in turn covered by the upper footrest cushion 38. The central portion of the main body 172 is pivotally interconnected to the upper extension link 142 at a pivot 178. The end of the main body 172 opposite the upper footrest plank 180 is pivotally interconnected to one end of the control link 166 at the pivot 176. Notably, the main body 172 is of sufficient length that the upper footrest cushion 38 is disposed at r approximately the same height as the lower footrest cushion 36 when the chair 10 is in the reclined position. The opposite end of the control link 166 is connected to a central portion of the lower extension link 148 at a pivot 168.

Reclining of the chair 10 from the upright position of FIGS. 1 and 3 to the reclined position of the FIGS. 2 and 4 begins with the chair 10 in the upright position. In the upright position (FIG. 3), the seat 21 is generally above the base 12 and is disposed at a predetermined pitch angle relative to the underlying surface. This pitch angle, which is selected to provide a comfortable seating surface, is typically between about 0 and 10 degrees. The lower and upper footrest cushions 36, 38 are generally upright and are disposed beneath a forward portion of the seat 21 in generally stacked relationship, with the upper footrest cushion 38 being sandwiched between the seat 21 and the lower footrest cushion 36, and with the upper and lower footrest cushions 38, 36 measuring between about 10 and 14 inches in height in stacked relationship. The side panels 30*a*, 30*b* are disposed beneath the seat rails 23*a*, 23*b*, with the arcuate lower surfaces of the seat rails 23*a*, 23*b* in an adjacent noncontacting relationship with the upper surfaces of the side panels 30*a*, 30*b*. The actuating linkage 100 is in a retracted position, with the extension finger 106 of the bell crank 104 extending forwardly and the forward recess 110 of the drive link 108 nesting the axle 102. The links of the footrest linkage 130 are folded upon one another rearward of the upper and lower footrest cushions 36, 38 and forward of the actuating linkage 100. The rear swing link 90 extends upwardly and slightly rearwardly from pivot 92. The front swing link 96 extends upwardly and slightly forwardly from pivot 99 and overlies the lower thrust link 138. The footrest drive link 120 is disposed so that its rear portions 122 is generally horizontally disposed and the forward portion 124 overlies the front swing link 96. The spring 76 is in a relatively relaxed condition.

In the upright position, the mechanism 60 is folded into a package of a size that enables the mechanism 60 to fit within the space available beneath the seat 21 and behind the lower and upper footrest cushions 36, 38 and still allow the seat 21 to glide relative to the base 12. In particular, the inclusion of the front swing link 96 and footrest drive link 120 enables the mechanism 60 to retract into a smaller package than many prior art mechanisms.

Reclining of the chair 10 is actuated by rotation of the axle 102 within the axle apertures 69 of the side panel brackets 62 via the handle (not shown). Rotation of the handle causes the axle 102 to rotate within the axle aperture 69 so that the extension finger 106 of the bell crank 104 moves upwardly and rearwardly (i.e., counter clockwise as seen in FIGS. 3 and 4). Rotation of the bell crank 104 drives the drive link 108 rearwardly, and also causes its forward end to rise. The rearward movement of the rear end of the drive link 108 causes the seat bracket 80 (and consequently the seat 21) to move rearwardly relative to the side panels 30*a*, 30*b*. The path followed by the seat bracket 23 is controlled by the front and rear swing links 96, 90. In the reclined position, the upper end of the rear swing link 90 has moved rearwardly and slightly downwardly, and the upper end of the front swing link 96 has moved rearwardly. This movement places the seat 21 in a position relative to the side panels 30, 30*b* that is rearward of its relative position in the upright position. Those skilled in this art will appreciate that other actuating mechanisms, such as trigger-based weight-driven mechanisms, can also be used with the present invention. Also, the seating unit 10 can also be actuated by simply having the occupant push on the armrests of the seating unit if the seating unit is a non-gliding unit.

As the seat bracket 80 moves rearwardly during reclining, the footrest drive link 120 rotates about the pivot 126 so that the forward portion 124 rises and moves rearwardly relative to the side panel bracket 62. However, while the forward portion 124 follows this path, the rearward movement of the seat bracket 80 causes the pivot 143 between the forward portion 124 of the footrest drive link 120 and the lower thrust link 138 to move forwardly relative to the seat bracket 80. As a result, the footrest drive link 120 drives the lower thrust link 138 and, indirectly, the upper thrust link 132 to pivot relative to the seat bracket 80 about the pivots 98 and 134, respectively, so that the ends of these links 132, 138 opposite the pivots 98, 134 move upwardly and forwardly. Rotation of the upper and lower thrust links 132, 138 about the seat bracket 80 also causes the upper extension link 142 and the lower extension link 148 to unfold from the upper and lower thrust links 132, 138 and extend forwardly. In doing so, the lower extension link 148 moves forwardly relative to the upper extension link 142. This relative movement causes the lower footrest bracket 152, which travels with the upper and lower extension links 142, 148, to rotate relative to the underlying surface so that the lower footrest cushion 36 faces generally upwardly. The relative movement of the upper and lower extension links 142, 148 also drives the control link 166 forwardly, thereby rotating the upper footrest bracket 170 relative to the upper extension link 142 so that the upper footrest cushion 38 is disposed between and spaced away from the forward end of the seat 21 and the lower footrest cushion 36. The separation of the lower and upper footrest cushions 36, 38 and the seat 21 draws open the fabric connecting sheets 37, 39.

In the reclined position, the seat 21 has moved rearwardly relative to the side panels 30*a*, 30*b* and defines a pitch angle with the underlying surface that is slightly steeper than that defined by the seat 21 in the upright position. Both the upper footrest cushion 38 and the lower footrest cushion 36 are positioned forwardly of the seat 21 and are generally horizontally disposed. The sheet connectors 37, 39 are unfolded so that they cover the gaps between the footrest cushions 36, 38 and the seat 21. Preferably, the lower footrest plank 162 and the upper footrest plank 180 are spaced so that the gap therebetween is less than 5 inches; similarly, the upper footrest plank 180 and the seat panel 22 are spaced so that the gap therebetween is less than 5 inches. It is also preferred that the distance between the forwardmost end of the lower footrest plank 162 and the forwardmost end of the seat panel 22 is between about 17 and 22 inches.

As is preferred with the present invention, the lower surfaces of the seat rails 23*a*, 23*b* are in adjacent, noncontacting relationship with the upper surfaces of the side panels 30*a*, 30*b*; however, the seat rails 23*a*, 23*b* have moved rearwardly relative to the seat panels 30*a*, 30*b*. Despite this relative movement, the gap between these structures is still relatively constant due to the matching arcuate shapes of their adjacent surfaces, which resemble in shape the path of relative movement between the seat 21 and the side panels 30*a*, 30*b* during reclining. The retention of this relatively constant gap, which is preferably between about 0.05 and 0.5 inches, allows the chair 10 to maintain an attractive appearance in the reclined position and also prevents a child or occupant from getting his fingers pinched between the mating surfaces of the seat rails 23*a*, 23*b* and the side panels 30*a*, 30*b*.

In either of the upright or reclined positions, the chair 10 is free to glide relative to the base 12. The glide path, which is illustrated in FIG. 5, is controlled by the front and rear glide links 40, 46, as they are suspended from, respectively, the front and rear arms 18, 20 of the base 12. The glide links 40, 46 are configured and mounted relative to the seat 21 and the base 12 so that the seat 21 follows a comfortable glide path in both the upright and reclined positions when a seated occupant glides forwardly and rearwardly. A preferred glide path is attained by mounting the front glide link 40 so that the lower end of the front glide link 40 is positioned rearwardly from its upper end and by mounting the rear glide link 46 so that its lower end is positioned forwardly of its upper end as the seat 21 is freely suspended from the base 12. In the illustrated embodiment, gliding of the seating unit 10 is terminated by contact between the front stabilizer bar 41 and the front portion of the base tower 16, and by contact between the rear stabilizer bar 47 and the base rear arms 18. Those skilled in this art will recognize that other configurations for the glide links 40, 46, such as those in which the glide links 40, 46 are of different lengths and in which they are interconnected with the base 12 and side panels 30*a*, 30*b* in different positions, can be used with the present invention in the event a somewhat different glide path is desirable. Also, those skilled in the art will understand that other gliding means, such as compound cam systems, roller and track systems and the like, can also be used with the present invention.

The foregoing examples are illustrative of the present invention, and are not to be construed as limiting thereof. The invention is defined by the following claims, with equivalents of the claims to be included therein.

That which is claimed is:

1. A reclining seating unit, comprising:

a base configured to rest on an underlying surface;

a generally horizontally-disposed seat positioned above said base, said seat including a pair of rails attached to a lateral portion thereof, each of said rails having an arcuate lower edge of a preselected curvature;

a pair of side panels supported on said base each of which includes an arcuate upper edge positioned directly beneath and closely adjacent a respective seat rail lower edge, said arcuate upper edge having a preselected curvature that substantially matches the preselected curvature of a respective said seat rail lower edge;

at least one footrest panel; and a reclining mechanism interconnecting said seat, said side panels, and said at least one footrest panel for relative movement therebetween, said reclining mechanism being configured so that said seating unit is movable between an upright position and a reclined position, wherein in said upright position, said seat is disposed at a first pitch angle relative to said underlying surface and is positioned in a first forward orientation relative to said side panels, and said at least one footrest panel is generally upright and is positioned below a forward portion of said seat, and wherein in said reclined position, said seat is disposed at a second pitch angle relative to said underlying surface that differs from said first pitch angle and is positioned in a second rearward orientation relative to said side panels, and said at least one footrest panel is generally horizontally disposed and is positioned forwardly of said seat; and wherein, as said seating unit moves between said upright and reclined positions, said seat rail lower edges move rearwardly relative to said side panel upper edges substantially along paths defined by the preselected curvature of the seat rail lower edges and remain in closely adjacent noncontacting relationship with said side panel upper edges such that said seat is wholly supported above said side panels by said reclining mechanism.

2. The seating unit defined in claim 1, further comprising gliding means supporting and interconnecting each of said side panels with said base, said gliding means being configured so that said side panels, said seat, and said at least one footrest panel are free to travel along a predetermined generally longitudinal path relative to said base.

3. The seating unit defined in claim 2, wherein said gliding means comprises:

a pair of front glide links, each of which is pivotally interconnected at an upper end to a respective forward portion of said base and at an opposite lower end to a forward portion of a respective side panel; and a pair of rear glide links, each of which is pivotally interconnected at an upper end to a respective rear portion of said base and at an opposite lower end to a rear portion of a respective side panel.

4. The seating unit defined in claim 3, wherein each of said front glide links is mounted to said base and to said respective side panel so that when said seating unit is unoccupied, said front glide link lower end is positioned rearwardly of said front glide link upper end.

5. The seating unit defined in claim 4, wherein each of said rear glide links is mounted to said base and said respective side panel so that, when said seating unit is unoccupied, said rear glide link upper end is positioned rearwardly of said rear glide link lower end.

6. The seating unit defined in claim 1, wherein in the upright position, and wherein said footrest panel is a first of a pair of footrest panels and is positioned above a second of said pair of footrest panels, and in the reclined position, said first footrest panel is positioned generally between said second footrest panel and said seat.

7. The seating unit defined in claim 6, wherein said first footrest panel and said second footrest panel together have a vertical dimension of between 10 and 14 inches in the upright position, and wherein each of a first gap between said first and second footrest panels and a second gap between said first footrest panel and said seat is less than 5 inches and a forwardmost end of said second footrest panel is between 17 to 22 inches from said seat when said seating unit is in the reclined position.

8. The seating unit defined in claim 1, wherein said second pitch angle is steeper than said first angle.

9. The seating unit defined in claim 1, further comprising a generally upright backrest fixed to a rear portion of said seat.

10. A reclining seating unit, comprising:

a base configured to rest on an underlying surface;

a generally horizontally-disposed seat positioned above said base, said seat including a pair of rails attached to a lateral portion thereof, each of said rails having an arcuate lower edge;

a pair of side panels supported on said base and positioned generally below said seat, each of said side panels including an arcuate upper edge positioned generally below and in closely adjacent noncontacting relationship with a respective seat rail lower edge, said arcuate upper edges having a preselected curvature that substantially matches a preselected curvature of said respective seat rail lower edge;

at least one footrest panel; and a reclining mechanism interconnecting said seat, said side panels, and said at least one footrest panel for relative movement therebetween, said reclining mechanism being configured so that said seating unit is movable between an upright position and a reclined position, wherein in said upright position, said seat is disposed at a first pitch angle relative to said underlying surface and is positioned in a first forward orientation relative to said side panels, and said at least one footrest panel is generally upright and is positioned below a forward portion of said seat, and wherein in said reclined position, said seat is disposed at a second pitch angle relative to said underlying surface that differs from said first pitch angle and is positioned in a second rearward orientation relative to said side panels, and said at least one footrest panel is generally horizontally disposed and is positioned forwardly of said seat; and wherein said side panel upper edges and said seat rail lower edges are shaped so that, as said seating unit moves between said upright and reclined positions, said seat rail lower edges move generally longitudinally relative to and remain in closely adjacent noncontacting relationship with said side panel upper edges such that said seat is wholly supported above said side panels by said reclining mechanism.

11. The seating unit defined in claim 10, further comprising gliding means interconnecting each of said side panels with said base, said gliding means being configured so that said side panels, said seat, said backrest, and said at least one footrest panel are free to travel along a predetermined generally longitudinal path relative to said base.

12. The seating unit defined in claim 11, wherein said gliding means comprises:

a pair of front glide links, each of which is pivotally interconnected at one end to a respective forward portion of said base and at its opposite end to a forward portion of a respective side panel; and a pair of rear glide links, each of which is pivotally interconnected at one end to a respective rear portion of said base and at its opposite end to a rear portion of a respective side panel.

13. The seating unit defined in claim 12, wherein each of said front glide links is mounted to said base and to said respective side panel so that when said seating unit is unoccupied, said front glide link lower end is positioned rearwardly of said front glide link upper end.

14. The eating unit defined in claim 13, wherein each of said rear glide links mounted to said base and said respective side panel so that, when said seating unit is unoccupied, said rear glide link upper end is positioned rearwardly of said rear glide link lower end.

15. The seating unit defined in claim 10, wherein said seat rail lower edges are concave and said side panel upper edges are convex.

16. The seating unit defined in claim 10, wherein said second pitch angle is steeper than said first pitch angle.

17. The seating unit defined in claim 10, wherein said side panel upper edges and said seat rail lower edges are in noncontacting relationship when the seating unit is in the upright position and in the reclined position.

18. The seating unit defined in claim 10, further comprising a generally upright backrest fixed to a rear portion of said seat.

* * * * *